US007461579B2

(12) United States Patent
Kobayashi

(10) Patent No.: US 7,461,579 B2
(45) Date of Patent: Dec. 9, 2008

(54) PUNCH PRESS

(75) Inventor: Hiroshi Kobayashi, Kani (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 164 days.

(21) Appl. No.: 10/745,625

(22) Filed: Dec. 29, 2003

(65) Prior Publication Data

US 2004/0154453 A1 Aug. 12, 2004

(30) Foreign Application Priority Data

Feb. 6, 2003 (JP) ..... 2003-029649
Feb. 6, 2003 (JP) ..... 2003-030101

(51) Int. Cl.
*B26F 1/04* (2006.01)
*B26F 1/14* (2006.01)

(52) U.S. Cl. ..... 83/552; 83/571; 83/691

(58) Field of Classification Search ..... 83/552, 83/691, 571, 549, 534; 234/100, 113; 438/28–29; 408/35

See application file for complete search history.

(56) References Cited

U.S. PATENT DOCUMENTS 3,685,380 A * 8/1972 Daniels ..... 83/552
4,423,546 A * 1/1984 Scott et al. ..... 483/29
4,976,180 A * 12/1990 Otto ..... 83/133
5,390,575 A 2/1995 Saito
5,768,931 A * 6/1998 Gombas ..... 72/184
6,220,138 B1 * 4/2001 Sakamoto ..... 83/639.1

FOREIGN PATENT DOCUMENTS

EP 0 818 253 A2 1/1998
JP 01-241337 9/1989
JP 02-151324 6/1990
JP 4-3691 3/1991

(Continued)

OTHER PUBLICATIONS

Chinese Office Action dated Sep. 4, 2006, Application No. 2004100040132.

(Continued)

*Primary Examiner*—Ghassem Alie
(74) *Attorney, Agent, or Firm*—Westerman, Hattori, Daniels & Adrian, LLP.

(57) ABSTRACT

The present invention provides a punch press which enables cartridges to be easily replaced so that the replacement of the cartridges allows the use of a large number of tools, which enables tools in the cartridges to be quickly indexed, and which allows the accuracy of punching to be easily improved. Cartridges 3, 4 are used which hold tools 1, 2, respectively. Cartridge holders 6, 7 are provided which hold the cartridges 3, 4, respectively, that are supported by a punch frame 5 and located at a press position P. A ram 10 is provided above the cartridge means holders 6, 7. The cartridge holders 6, 7 have cartridge clamps 14, 15, respectively, removably holding the corresponding cartridges 3, 4. The cartridge holders 6, 7 have cartridge rotating mechanisms 16, 17, respectively, that rotate the held cartridges 3, 4 in order to index any of the tools 1, 2. The cartridge holders 6, 7 fix the cartridges 3, 4 during punching so that the cartridges cannot be moved in a vertical direction.

6 Claims, 10 Drawing Sheets

FOREIGN PATENT DOCUMENTS

| | | | |
|---|---|---|---|
| JP | 03-193225 | | 8/1991 |
| JP | 03198928 | A * | 8/1991 |
| JP | 4-3691 | | 2/1992 |
| JP | 6-85948 | | 11/1994 |
| JP | 7-16671 | | 1/1995 |
| JP | 63-230235 | | 9/1998 |
| JP | 2869129 | | 12/1998 |
| JP | 2000-351028 | | 12/2000 |

OTHER PUBLICATIONS

Chinese Office Action dated May 25, 2007, Application No. 2004100040132.

Notification of Reason(s) for Refusal dated Aug. 17, 2007, Application No. 2003-029649.

Notification of Reasons for Rufusal dated Jan. 8, 2008, Appl. No. 2003-029649.

* cited by examiner

PUNCH PRESS

FIELD OF THE INVENTION

The present invention relates to a punch press that enables a cartridge to be replaced and used.

BACKGROUND OF THE INVENTION

In the prior art, punch presses each enabling a plurality of tools to be replaced for use are commonly of a turret type. However, with the turret punch press, the types and sizes of tools that can be held on the turret are limited. Accordingly, the turret punch press cannot execute various types of working. Thus, only the measures described below have hitherto been available to improve the functions of the turret punch press.

One of the improved turret punch presses is a multitool type (for example, the Examined Japanese Patent Application Publication (Tokkou-Hei) No. 6-85948). In the multitool turret punch press, one or more of the tools held by the turret are multitools each having a plurality of unit tools. Any of the multitools is indexed and an arbitrary unit tool is then indexed to enable a punching operation.

Another improved turret punch press is a multiturret type (for example, the Japanese Patent No. 2869129). Subturrets are installed on a main turret at a plurality of positions in its circumferential direction so as to be freely rotatively indexed. Tools are arranged on each of the subturrets at a plurality of positions in its circumferential direction.

Further another improved turret punch press is a cartridge type (for example, the Unexamined Japanese Patent Application Publication (Tokkai-Hei) No. 2000-351028). With the cartridge type punch press, a plurality of rectangular cartridges are provided each of which is equipped with a plurality of tools. Each of these cartridges is moved to and away from a punch position on a rail for replacement, the rail constituting a straight path.

In the multitool example, before punching, the entire multitool is lowered until it comes into contact with a surface of a plate material. Subsequently, one of the unit tools is lowered to perform a punching operation. Accordingly, the punching operation may be associated with a combination of an error resulting from the elevating and lowering of the multitool and an error resulting from the elevating and lowering of the unit tool relative to the multitool main body. It is thus difficult to achieve accurate punching.

The multiturret type punch press requires the pivotal indexing of the main turret and the pivotal indexing of one of the subturrets held by the main turret. It is also difficult to accurately achieve these pivotal indexing operations. Furthermore, the size of the entire punch press must be increased.

The center of the turret type cannot be used for a die. Accordingly, the use of a die with a larger diameter is limited.

The cartridge type punch press allows a cartridge to be replaced at a press position by linearly reciprocating the cartridge. Accordingly, if the cartridge is to be replaced with an arbitrary one, then after the old cartridge has been discharged, the desired cartridge must be moved into the press position. This increases the time required to replace the cartridge. Furthermore, any of the tools arranged in the cartridge is indexed by moving a punch driving section on a plane, the punch driving section having a ram. Consequently, the moved portion is heavy, thus making it difficult to quickly index the desired tool. Although some punch presses of this type index the desired tool in one direction by linearly moving the cartridge, they also require the entire cartridge to be linearly moved. Consequently, it is also difficult to achieve quick indexing.

It is an object of the present invention to provide a punch press which enables cartridges to be easily replaced so that the replacement of the cartridges allows the use of a large number of tools, which enables any of the tools in the cartridges to be quickly indexed, and which allows the accuracy of punching to be easily improved.

It is another object of the present invention to enable punching operations such as the formation of larger holes, cutting, forming, and bending.

It is yet another object of the present invention to provide a punch press which enables cartridges to be quickly and easily replaced with desired ones so that the replacement of the cartridges allows the use of a large number of tools, which allows the accuracy of punching to be easily improved, and which can be simply configured.

It is still another object of the present invention to enable punching operations such as the formation of larger holes, cutting, forming, and bending.

It is further another object of the present invention to enable a cartridge to be quickly delivered at a press position and to enable a cartridge held by a cartridge replacing device to be easily replaced at a position different from the press position.

It is further another object of the present invention to enable any of the tools in the cartridges to be quickly indexed and to require only one cartridge rotating mechanism.

SUMMARY OF THE INVENTION

The present invention provides a punch press comprising cartridges each holding at least one tool, cartridge holding means supported by a punch frame and for holding the cartridge located at a press position, and a ram located above the cartridges held by the cartridge holding means to drive the tools held by the respective cartridges to execute punching, the cartridge holding means each having a cartridge clamp removably holding the corresponding cartridges and a cartridge rotating mechanism that rotates the held cartridges around an axis parallel with an elevating and lowering direction of the ram in order to index any of the tools, the cartridge holding means fixing the cartridges during punching so that the cartridges cannot be moved in a vertical direction.

With this arrangement, each of the cartridge holding means uses the cartridge clamp to hold the corresponding cartridges. Each of the cartridge rotating mechanisms rotates the held cartridges to index one of the tools to be used. A punching operation is performed by using the ram to drive the indexed tools for punching. In this case, the cartridges are fixed by the cartridge holding means so as to be immovable in the vertical direction. Since the cartridges are not moved in the vertical direction, accurate punching can be accomplished. Since each cartridge holding means has the cartridge clamp removably holding the cartridges, the cartridges can be easily replaced. By replacing the cartridges with ones holding different types of tools, a large number of tools can be used to achieve various types of working. Furthermore, the punch press has the cartridge rotating mechanisms to rotate the cartridges to quickly index one of the tools in the cartridge. The term "punching" as used herein refers to working which can be carried out using the punch press and which includes not only punching but also cutting, forming, and bending.

Each of the cartridge holding means may have a space formed in its center and through which the ram elevates and lowers, to hold an outer peripheral portion of each of the cartridges. For example, the cartridge holding means holds the outer peripheral portion of the cartridge at a plurality of positions in its circumferential direction.

When the cartridge holding means thus has a space formed in its center and through which the ram elevates and lowers, a large tool can be arranged in the center of each cartridge to accomplish larger-scale punching.

Each of the cartridge holding means may be movable between a fixed height position at which the cartridges are fixed so as to immovable in the vertical direction and a withdrawn height position at which the cartridge are moved away from the fixed height position relative to a die height.

When the cartridge holding means can be withdrawn so as to move away relative to the die height, the cartridges in the punch press can be easily replaced.

DETAILED DESCRIPTION OF THE PREFERRED EMBODIMENTS

Figure 1:
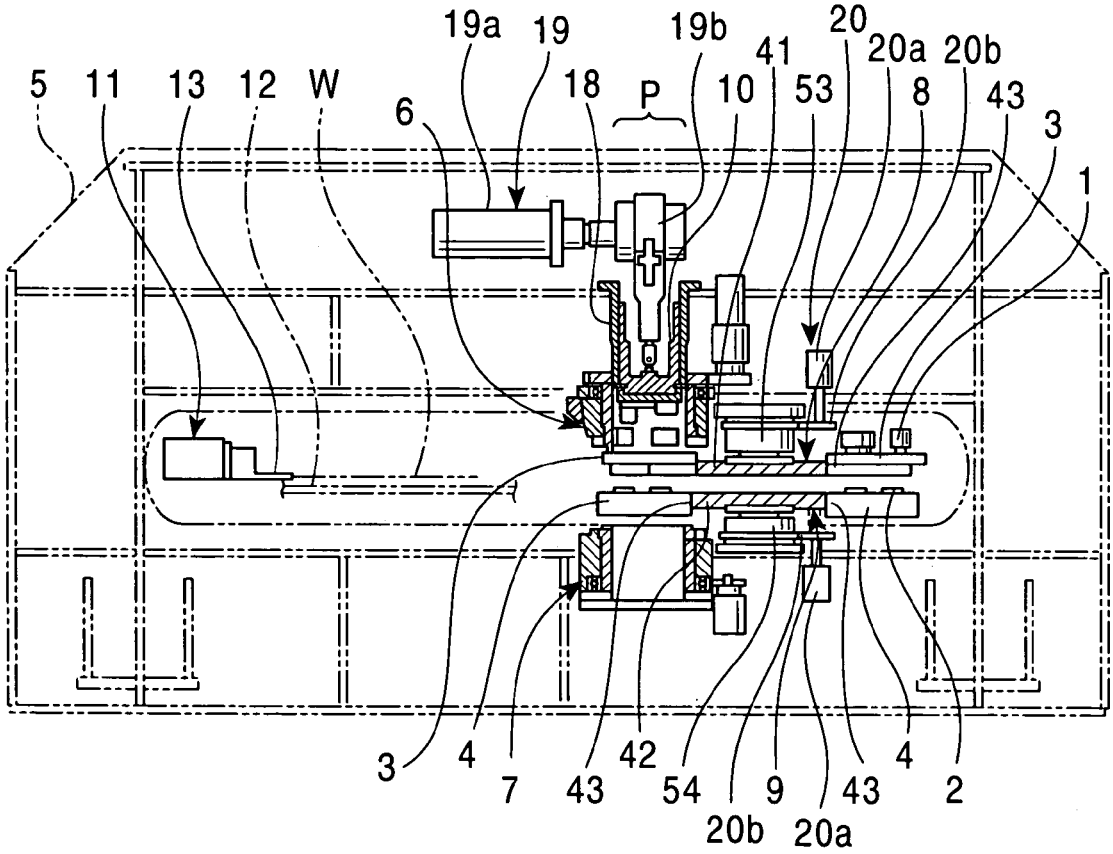
FIG. 1 is an exploded side view of a punch press according to an embodiment of the present invention.

An embodiment of the present invention will be described with reference to the drawings. As shown in FIG. 1, in this punch press, cartridges 3, 4 holding tools 1, 2, respectively, are held at a press position P by cartridge holding means 6, 7, respectively, for punching. The punch press has cartridge replacing devices 8, 9, a ram 10, and plate material feeding means 11. The cartridge holding means 6, 7 hold the cartridges 3, 4 located at the press position P. The cartridge holding means 6, 7 are supported by a punch frame 5. The cartridges 3, 4 are formed to appear substantially circular in a plan view. The press position P refers to a planar position at which the ram 10 is arranged.

The tools 1, 2 include a punch tool 1 constituting an upper die and a die tool 2 constituting a lower die. The cartridges 3, 4 include a punch cartridge 3 holding the punch tool 1 and a die cartridge 4 holding the die tool 2. Each punch tool 1 is supported on the punch cartridge 3 so as to elevate from and return to the punch cartridge 3 under the force of a spring member. The cartridge holding means 6, 7 include punch cartridge holding means 6 holding punch cartridges 3 and die cartridge holding means 7 holding die cartridges 4. The cartridge holding means 6, 7 are concentrically arranged so that the punch cartridge holding means 6 lies above the die cartridge holding means 7. The cartridge replacing devices 8, 9 also include a punch cartridge replacing device 8 and a die replacing device 9 concentrically arranged so that the punch cartridge replacing device 8 lies above the die cartridge replacing device 9.

The ram 10 is located above the cartridges 3, 4 held by the cartridge holding means 6, 7, respectively, to drive the punch tool 1 for punching, the punch tool 1 being held by the punch cartridge 3. The ram 10 is supported at the press position P by a ram elevating and lowering guide 18 so as to freely elevate and lower. The ram 10 is driven by a ram elevate and lower driving device 19 so as to elevate and lower freely. The ram elevate and lower driving device 19 is composed of, for example, a servo motor 19*a* and a motion converting mechanism 19*b* that converts the rotation of the servo motor 19*a* into linear motion. Alternatively, the ram elevate and lower driving device 19 may be a hydraulic cylinder or the like. The plate material feeding means 11 moves a plate material W forward, backward, rightward, and leftward on a table 12, the plate material W being to be wrought. The plate material feeding means 11 uses a work holder 13 to grip an edge portion of the plate material W. The work holder 13 is moved to move the plate material W forward, backward, rightward, and leftward.

The cartridge replacing devices 8, 9 replace the cartridges 1, 2, respectively, that are placed on the corresponding cartridge holding means 6, 7. The cartridge replacing devices 8, 9 has a function of removably holding the plurality of cartridges 3, 4. The cartridge replacing devices 8, 9 can be pivoted because replacement cartridge holding members 41, 42 formed like pivoting wheels are supported via support tables 53, 54, respectively, so as to pivot freely in a horizontal direction. The cartridge replacing devices 8, 9 are pivoted by an indexing mechanism 20 so that arbitrary cartridges 3, 4 can be placed at the press position P. The indexing mechanism 20 uses driving sources 20*a*, 20*b* such as servo motors to pivotally drive the upper and lower cartridge replacing devices 8, 9 via transmission mechanisms 20*b*, 20*b*, respectively. The upper and lower cartridge replacing devices 8, 9 are, for example, synchronously driven. The upper and lower cartridge replacing devices 8, 9 need not necessarily be synchronized to each other. For example, the lower cartridge replacing device 9 alone may be pivoted. Furthermore, even if the cartridge replacing devices 8, 9 are both pivotally driven, they need not be perfectly synchronized to each other. There may be a small difference in operational timing or speed between the cartridge replacing devices 8, 9. The indexing mechanism 20 may use a common driving source 20*a*' to pivotally drive the upper and lower cartridge replacing devices 8, 9 via a transmission mechanism 20*b*'.

Figure 2:
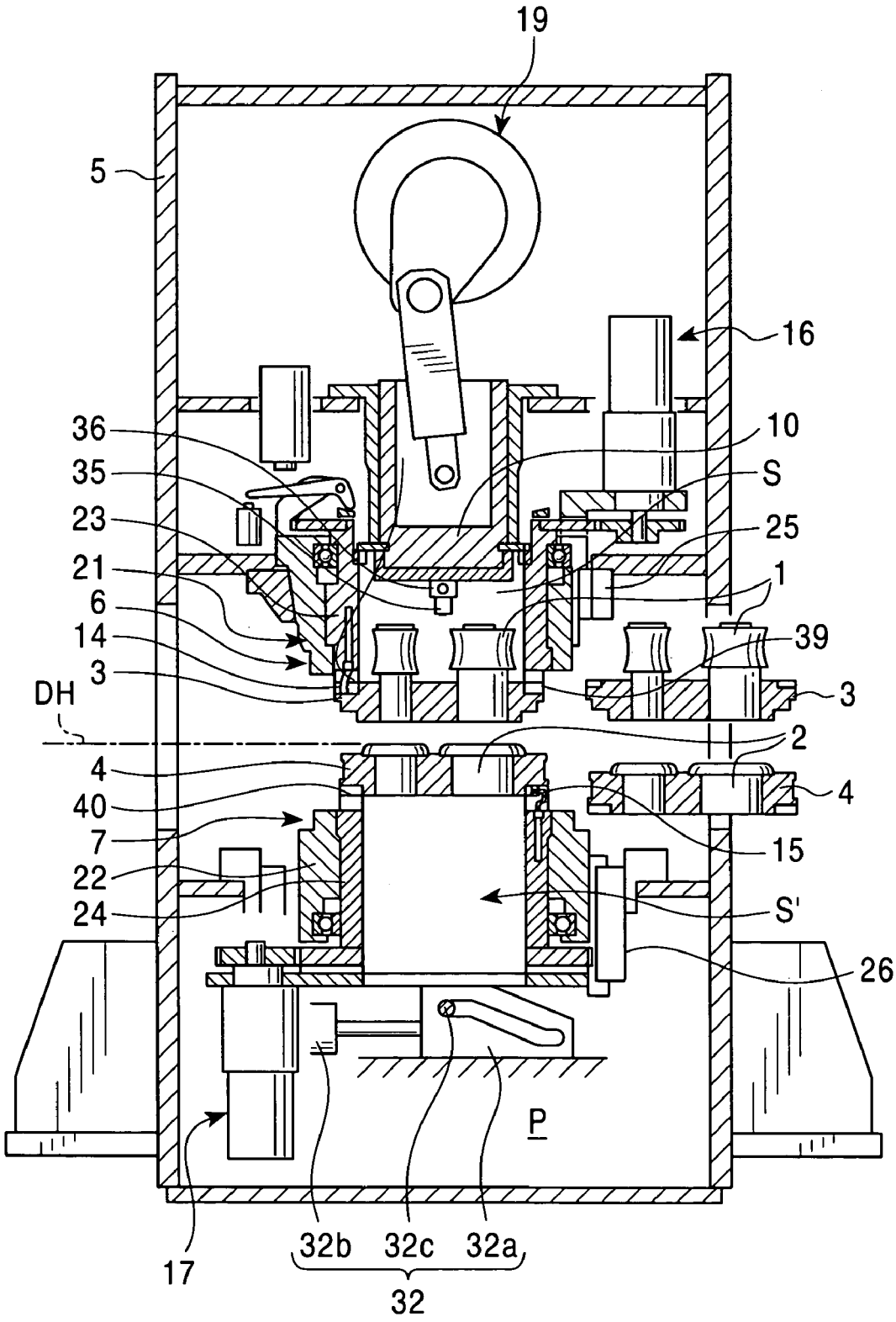
FIG. 2 is an enlarged exploded front view of the punch press.

As shown in FIG. 2, the upper and lower cartridge holding means 6, 7 have cartridge clamps 14, 15, respectively, that removably hold the corresponding cartridges 3, 4. The upper and lower cartridge holding means 6, 7 also have cartridge rotating mechanisms 16, 17, respectively, that rotate the held cartridges 3, 4 around respective axes parallel with an elevating and lowering direction of the ram 10 in order to index any of the tools 1, 2. The cartridge holding means 6, 7 fix the cartridges during punching so that the cartridges cannot be moved in the vertical direction. The cartridge holding means 6, 7 have a space S through which the ram 10 elevates and lowers and a space S' through which slag passes, respectively, the spaces S, S' being formed in the center of the cartridge holding means 6, 7, respectively. The cartridge holding means 6, 7 hold outer peripheral portions of the cartridges 3, 4, respectively. The cartridge holding means 6, 7 are movable between a fixed height position (shown in FIGS. 2 and 7) at which the cartridges 3, 4 are fixed so as to be immovable in the vertical direction and a withdrawn height position (shown in FIG. 6) at which the cartridges 3, 4 are moved away from the fixed height position relative to a die height DH.

Figure 7:
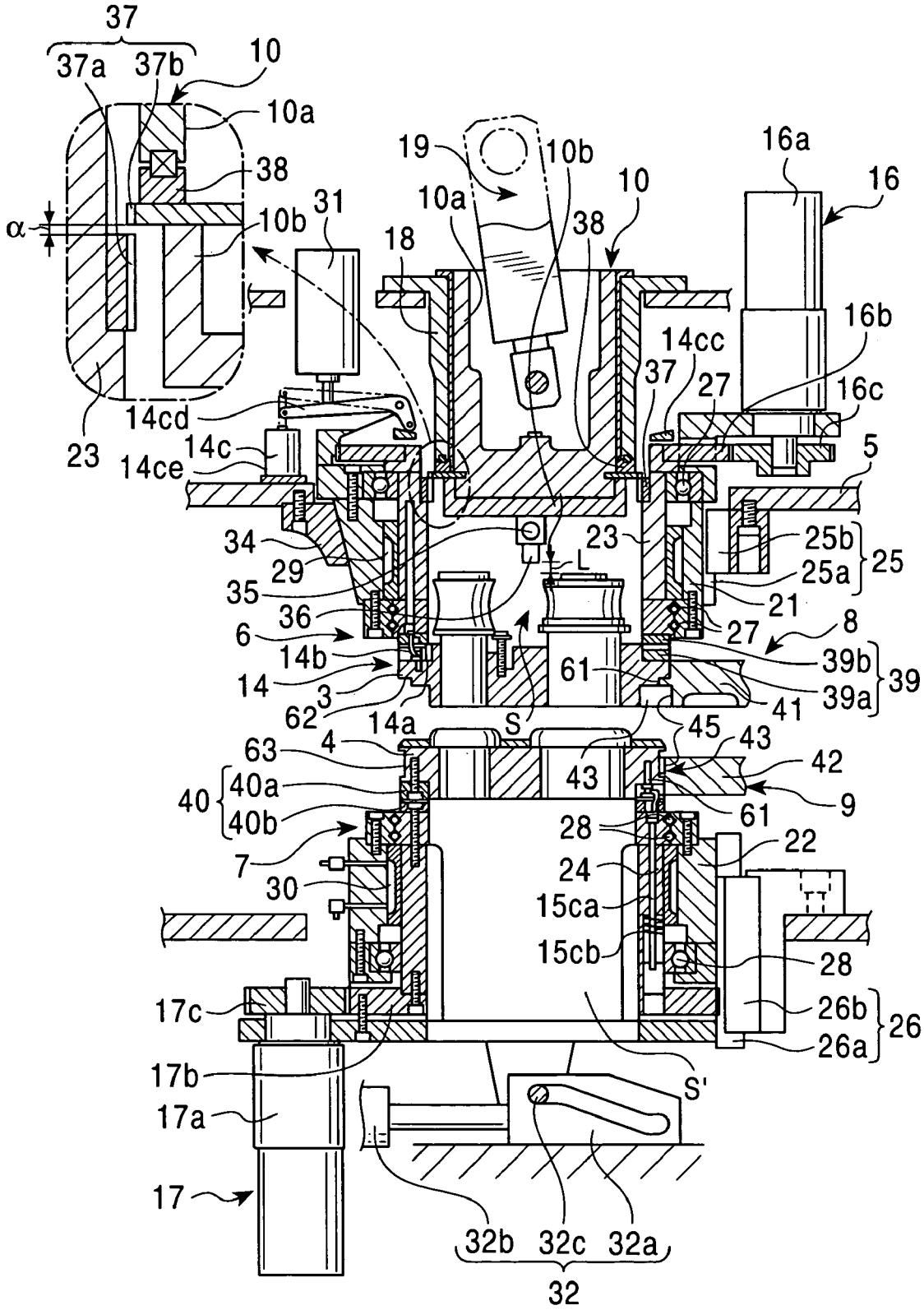
FIG. 7 is an enlarged exploded front view of the essential parts of the punch press, showing that the cartridges are clamped.
Figure 10:
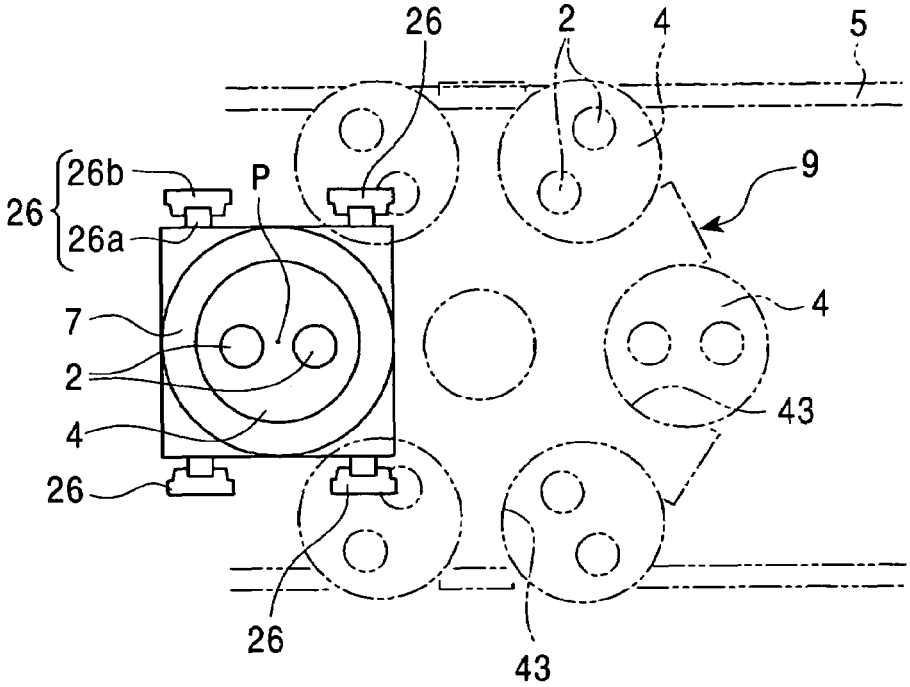
FIG. 10 is a schematic plan view showing the arrangement relationship between the cartridge holding means and the cartridge replacing device.

FIG. 7 is an enlarged view of the essential parts of FIG. 2. Specifically, the upper and lower cartridge holding means 6, 7 have elevating and lowering cylinders 21, 22, respectively, and rotating cylinders 23, 24, respectively, that are fitted inside the inner peripheries of the corresponding elevating and lowering cylinders 21, 22 so as to be only freely rotatable. The rotating cylinders 23, 24 hold the cartridges 3, 4, respectively. The elevating and lowering cylinders 21, 22 are supported by a press frame 5 via elevating and lowering guides 25, 26, respectively, so as to elevate and lower freely. The elevating and lowering guides 25, 26 are composed of guide projections 25*a*, 26*a*, respectively, that are provided on the corresponding elevating and lowering cylinders 21, 22, and guide members 25*b*, 26*b*, respectively, which are, for example, direct-acting bearings and which are installed on the press frame 5. The elevating guides 25, 26 are provided at a plurality of positions, e.g. four positions in the circumferential direction of the elevating and lowering cylinders 21, 22, respectively (see FIG. 10).

Figure 9B:
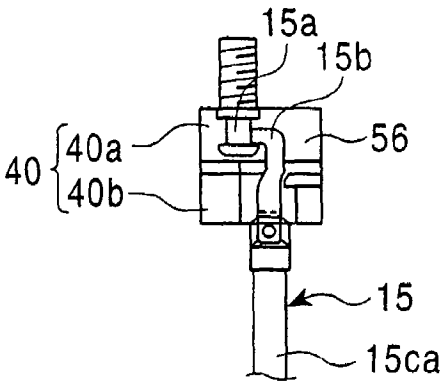
FIG. 9B is a side view of essential parts of a cartridge clamp of the die cartridge holding means.
Figure 9A:
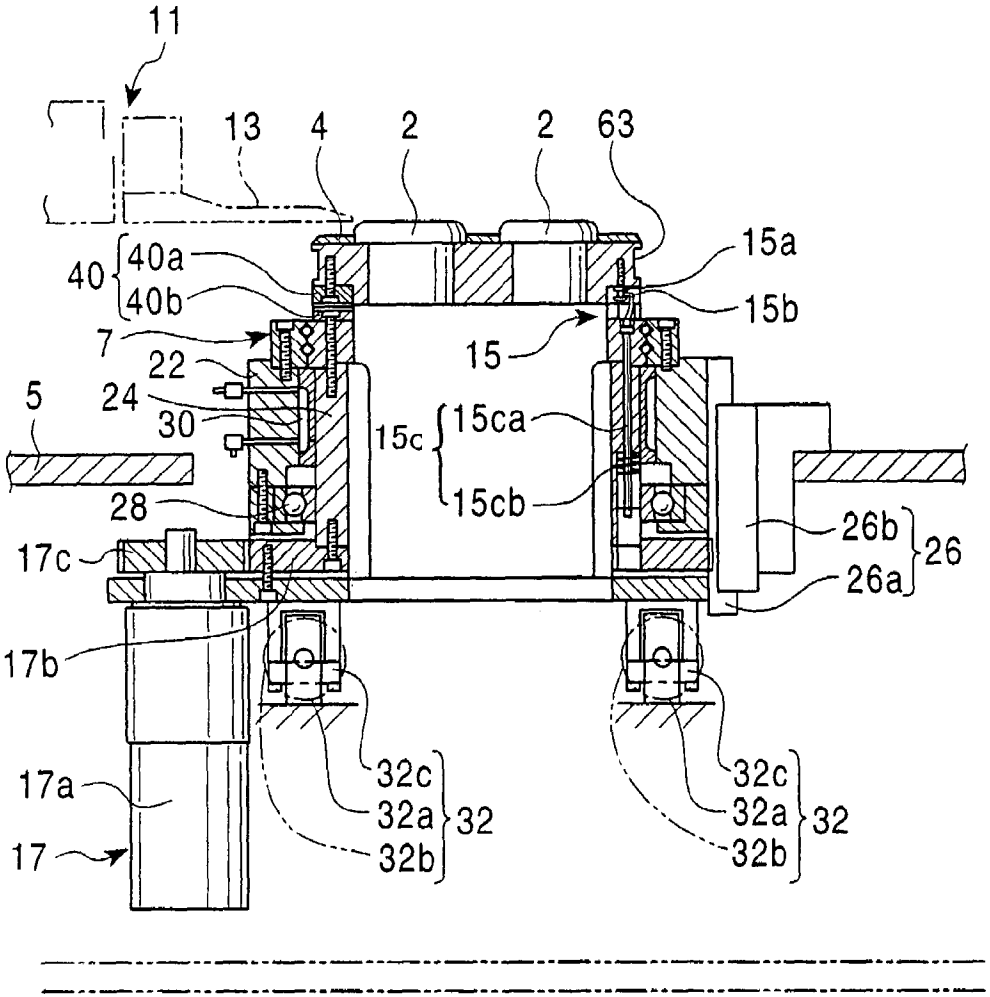
FIG. 9A is an enlarged exploded front view of the die cartridge holding means.

In FIG. 7, the elevating and lowering cylinders 21, 22 are elevated or lowered to withdraw the cartridge holding means 6, 7, respectively, as described above. The elevating and lowering cylinders 21, 22 are driven by holding means elevating and lowering devices 31, 32, respectively, so as to elevate and lower. The holding means elevating and lowering device 31 of the punch cartridge holding means 6 is composed of a fluid cylinder installed on the punch frame 5 or a rotation and direct-action converting mechanism such as a motor and ball screw. The holding means elevating and lowering device 32 of the die cartridge holding means 7 is composed of a cam 32*a*, a driving section 32*b* that advances and withdraws the cam 32*a*, and a guided member 32*c* provided on the elevating and lowering cylinder 22 to engage with a cam surface of the cam 32*a*. The driving section 32*b* is composed of a fluid cylinder or a rotation and direct-action converting mechanism such as a motor and ball screw. The cam 32*a* is composed of a groove cam or the like. The guided member 32*c* is composed of a roller or the like. The die-side holding means elevating and lowering device 32 is provided at two positions corresponding to the outer peripheral portions of the elevating and lowering cylinder 22 as shown in FIG. 9. In FIG. 7, for the elevating and lowering cylinder 21 of the punch cartridge holding means 6, a positioning guide 34 is provided on the punch frame 5 to stop lowering the elevating and lowering cylinder 21 when the cylinder 21 lowers to its fixed position, and then to center the cylinder 21. The positioning guide 34 is a member having a tapered surface that is fitted on a tapered surface portion of an outer peripheral surface of the elevating and lowering cylinder 21.

Bearings 27, 28 are interposed between the rotating cylinder 23 and the elevating and lowering cylinder 21 and between the rotating cylinder 24 and the elevating and lowering cylinder 22, respectively, so as to rotatably support these cylinders. Rotation fixing means 29, 30 are provided between the rotating cylinder 23 and the elevating and lowering cylinder 21 and between the rotating cylinder 24 and the elevating and lowering cylinder 22, respectively, so as to hinder the rotation of these cylinders. The rotation fixing means 29, 30 are each composed of an oil chamber having an inner peripheral wall portion that can be expanded. A rotation fixed state is established when an external oil pressure supplying device (not shown in the drawings) exerts pressure on this oil chamber. A rotation non-hindered state is established when the oil pressure is released.

The cartridge rotating mechanisms 16, 17 rotate the rotating cylinders 23, 24, respectively. The cartridge rotating mechanisms 16, 17 are composed of rotation driving sources 16*a*, 17*a* such as motors and gears 16*c*, 17*c*, respectively. The gears 16*c*, 17*c* mesh with gear portions 16*b*, 17*b*, respectively, provided on the corresponding rotating cylinders 23, 24, to transmit the rotations of the corresponding rotating driving sources 16*a*, 17*a*.

In the ram 10, a rotating ram member 10*b* is attached to a lower end of a ram main body 10*a* so as to be only freely rotatable. The ram 10 pushes the punch tool 1 via a striker 24 projecting from a bottom surface of the rotating ram member 10*b*. The striker 35 is supported so as to be freely movable in a radial direction of the rotating ram member 10*b* via a guide. The striker 35 is advanced and withdrawn by a striker advancement and withdrawal driving source 36 such as a cylinder device. Varying the radial position of the striker 35 makes it possible to selectively push the punch tool 1 arranged at an arbitrary radial position of the punch cartridge 3.

An interlocking mechanism 37 is provided between the rotating ram member 10*b* and the rotating cylinder 23 of the cartridge holding means 6. When the elevating and lowering cylinder 21 lowers, the interlocking mechanism 37 meshes the rotating ram member 10*b* with the rotating cylinder 23 so as to transmit the rotation of the rotating cylinder 23 to the rotating ram member 10*b*. The interlocking mechanism 37 is composed of inward and outward meshing teeth 37*a*, 37*b* provided on the inner periphery of the rotating cylinder 23 and the outer periphery of the rotating ram member 10*b*, respectively. When the ram 10 is at its elevating end, the meshing teeth 37*a*, 37*b* are separated from each other in the vertical direction as shown in an enlarged view in the upper left of FIG. 7. When the ram 10 lowers slightly but the striker 35 is still at a height where it does not contact with the tool 1, the meshing teeth 37*a*, 37*b* mesh with each other. The vertical separation $\alpha$ between the meshing teeth 37*a*, 37*b* measured when the ram 10 is at its elevating end is properly set so as to be smaller than the vertical separation L between the striker 35 and the tool 10. Baffling means 38 is provided between the rotating ram member 10*b* and the lower end of the ram elevating and lowering guide 18. Thus, the baffling means 38 hinders the rotating ram member 10*b* from rotating freely except when the rotating cam member 10*b* is rotated by the interlocking mechanism 37. The baffling means 38 is composed of, for example, a friction ring urged against the ram elevating and lowering guide 18 by a spring member.

Couplings 39, 40 are provided between the cartridge 3 and the cartridge holding means 6 and between the cartridge 4 and the cartridge holding means 7, respectively, to regulate the their positions in a rotating direction. The couplings 39, 40 are of a meshing type and are, for example, curvic couplings. The couplings 39, 40 are composed of coupling members 39*a*, 40*a*, respectively, that are provided on outer peripheral portions of surfaces of the corresponding cartridges 3, 4 which are opposite to the corresponding cartridge holding means 6, 7, and coupling members 39*b*, 40*b*, respectively, that are provided on the corresponding cartridge holding means 6, 7. The coupling members 39*b*, 40*b* are provided at the tips of the rotating cylinders 23, 24, respectively.

Figure 3:
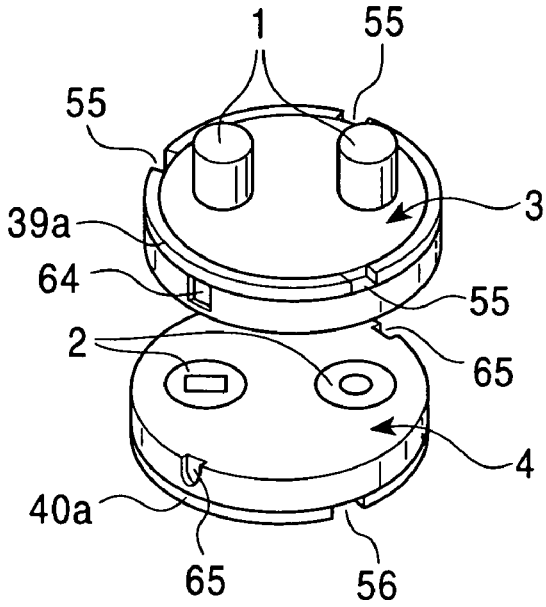
FIG. 3 is a perspective view of an example of cartridges.

The cartridge clamps 14, 15 are composed of engaged portions 14*a*, 15*a* (see FIG. 9B), respectively, that are provided on the corresponding cartridges 3, 4, hooks 14*b*, 15*b*, respectively, that are provided on the corresponding cartridge holding means 6, 7 to engage with the corresponding engaged portions 14*a*, 15*a*, and hook driving means 14*c*, 15*c* (FIG. 7), respectively. The engaged portions 14*a*, 15*a* are composed of, for example, engaging headed bolts. Each of the engaged portions 14*a*, 15*a* is provided at a plurality of positions, e.g. three positions of the cartridges 3, 4 in its circumferential direction. The engaged portions 14*a*, 15*a* are provided in notched concave portions 55, 56, respectively, that are formed in the corresponding coupling members 39*a*, 40*a* (FIG. 3). In FIG. 7, the hooks 14*b*, 15*b* are pivotally supported in the rotating cylinders 23, 24, respectively.

The upper and lower hook driving means 14*c*, 15*c* are configured in the same manner except that they are symmetric in the vertical direction. Thus, the illustration of some of the components is omitted. In the specification, reference numerals are shown only for the components of the hook driving means 14*c*, 15*c* which are shown in the figures. The hook driving means 14*c*, 15*c* are composed of rods 14*ca*, 15*ca*, respectively, which penetrate the corresponding rotating cylinders 23, 24 in an axial direction and which perform an advancing and withdrawing operations to pivot the corresponding hooks 14*b*, 15*b*, an engaging and urging spring 15*cb* that urges the rods 14*ca*, 15*ca* in a direction in which they engage with the corresponding hooks 14*b*, 15*b*, a rod pushing ring 14*cc* that can simultaneously push the rods 14*ca*, 15*ca* at a plurality of positions, a rotative moving lever 14*cd* that pushes the rod pushing ring 14*cc*, and a disengagement driving source 14*ce* such as a cylinder device or a solenoid which operates the rotative moving lever 14*cd*.

Figure 5A:
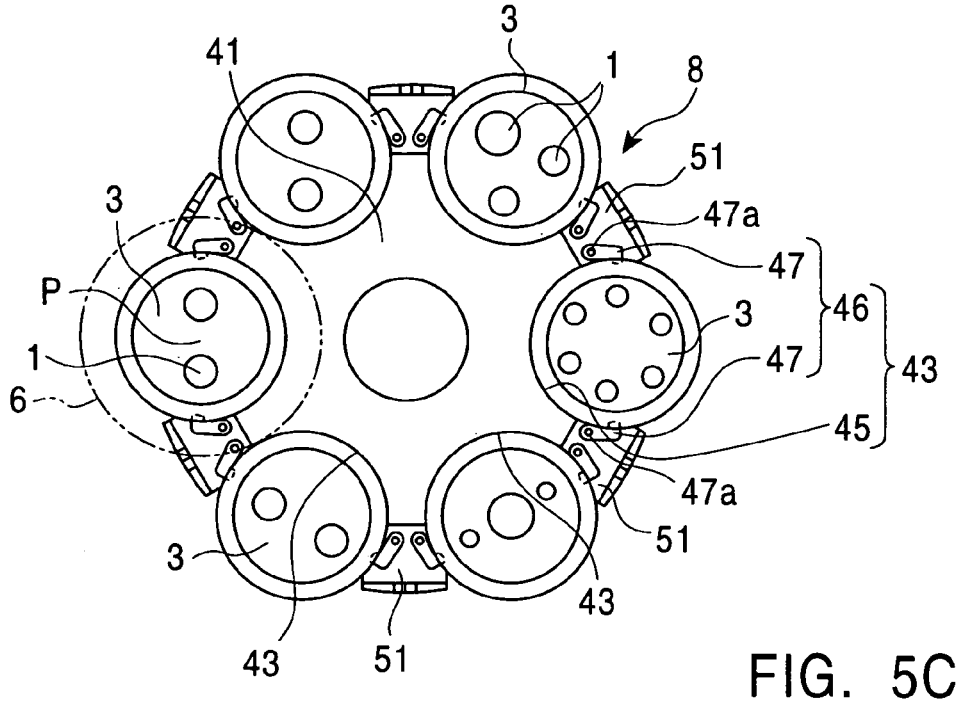
FIG. 5A is a plan view in which cartridges are installed on a cartridge replacing device.
Figure 5C:
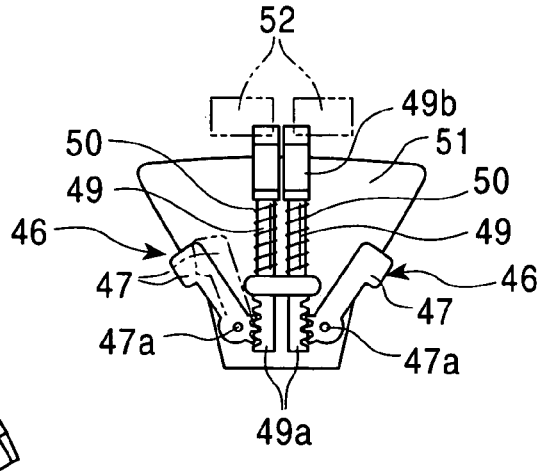
FIG. 5C is an enlarged plan view of a clamp member.
Figure 5B:
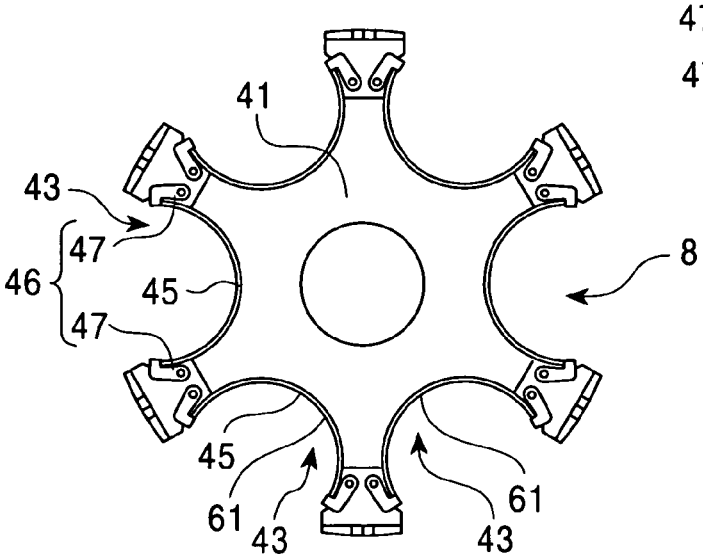
FIG. 5B is a plan view in which the cartridges are omitted.
Figure 8:
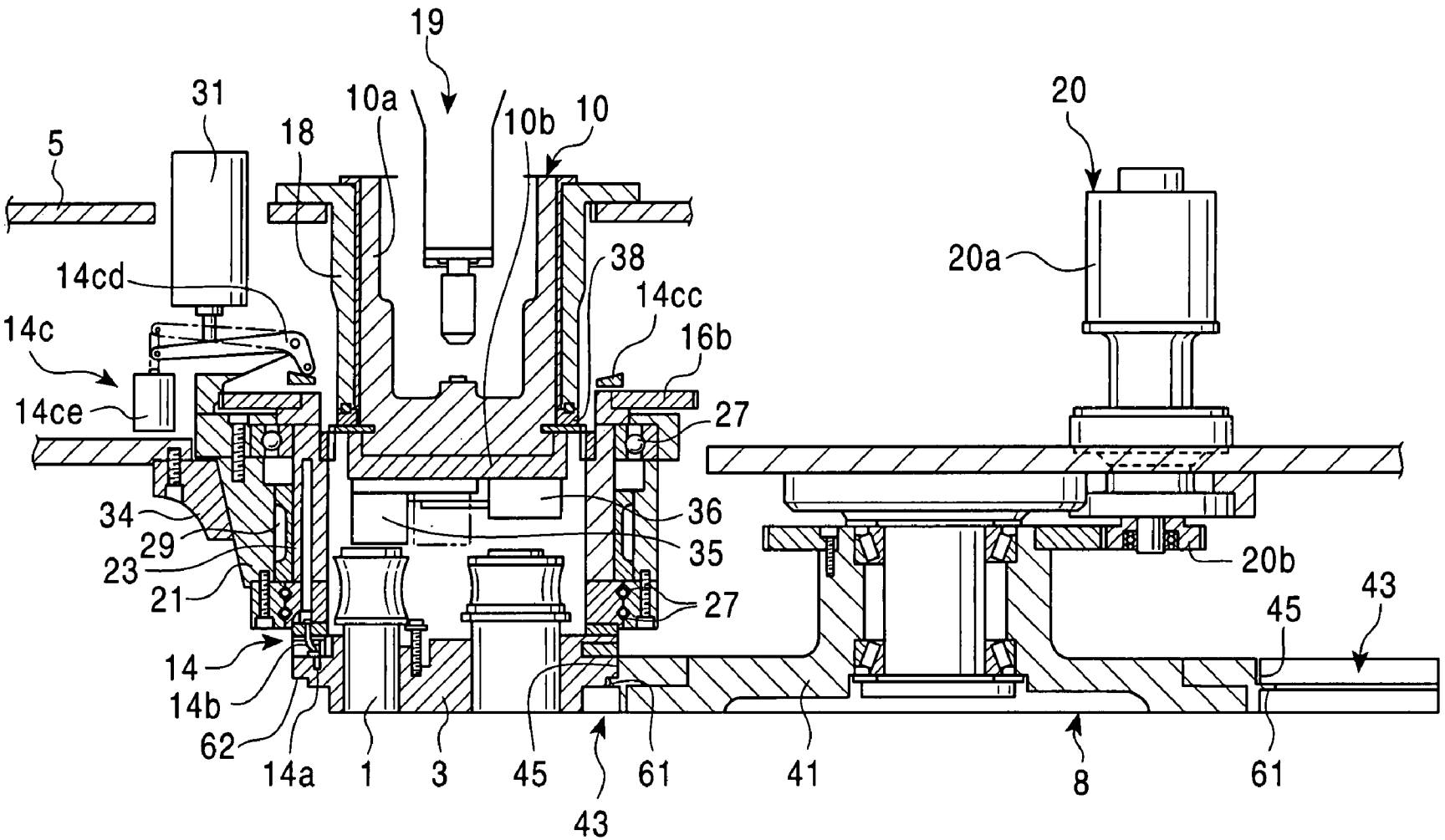
FIG. 8 is an enlarged exploded front view of the relationship between punch cartridge holding means and a cartridge replacing device.
Figure 11:
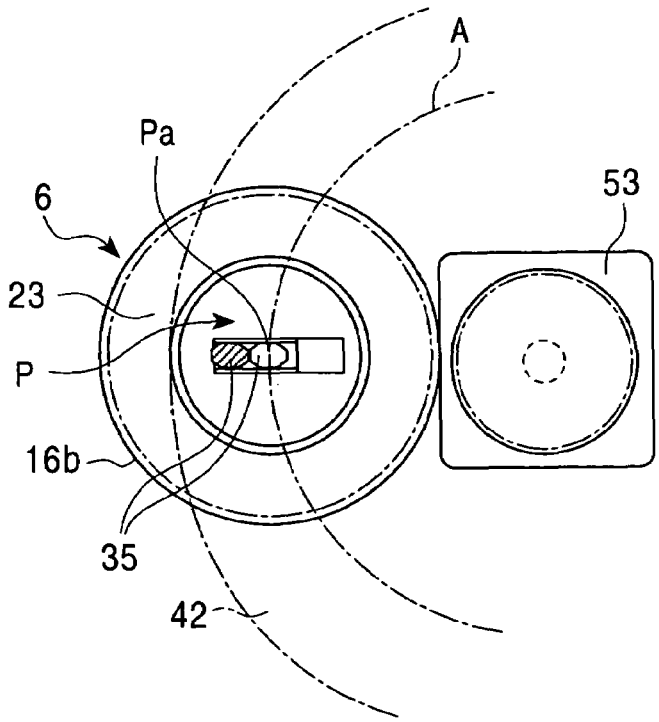
FIG. 11 is an enlarged plan view showing the relationship between the cartridge holding means and a pivoting locus of the cartridge replacing device.
Figure 12:
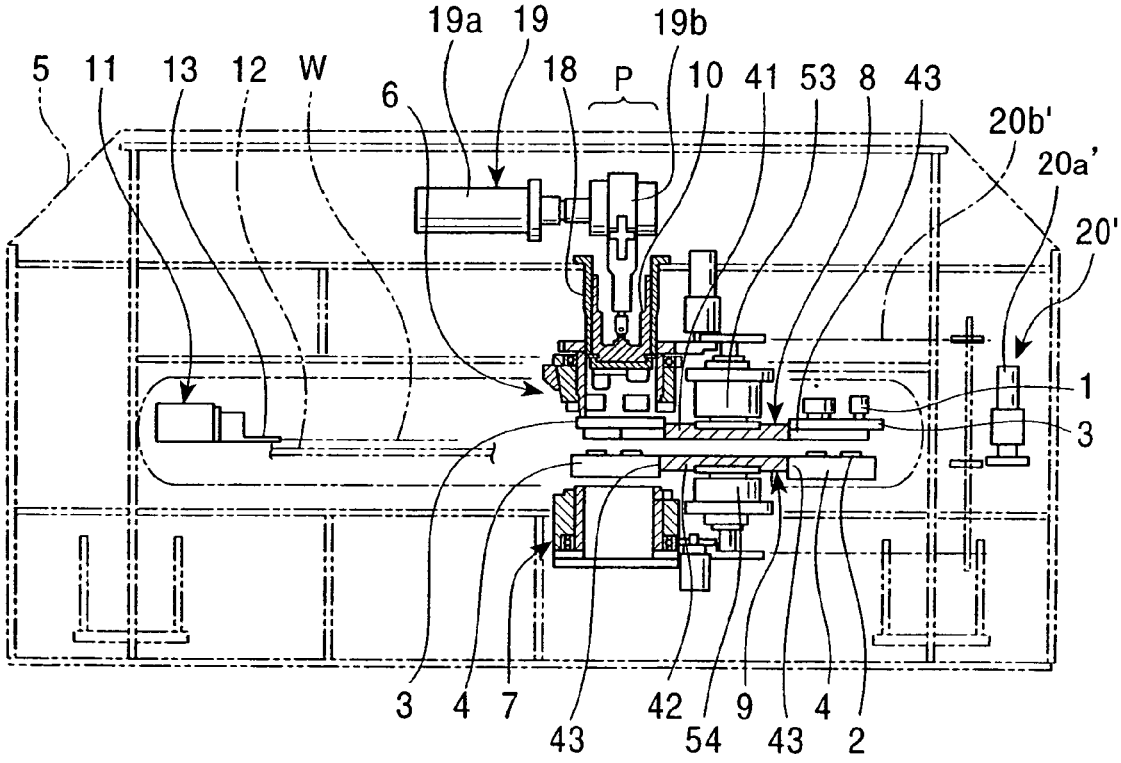
FIG. 12 is an exploded side view of a punch press according to another embodiment of the present invention.

In FIG. 1, in the cartridge replacing devices 8, 9, cartridge holding sections 43 are provided on each of the pivoting replacement cartridge holding members 41, 42 at a plurality of positions in their circumferential direction, to removably hold the cartridges 3, 4; the punch-side cartridge replacing device 8 is shown in FIGS. 5A and 5B. The details of the components of the upper cartridge replacing device 8 are denoted by the same reference numerals as those of the corresponding components of the lower cartridge replacing device 9 except for portions that must be specially distinguished from each other. The cartridge holding sections 43 are arranged on the same circumference. Accordingly, the pivoting locus A (FIG. 11) of the central position of the cartridge holding section 43 is endless. This endless pivoting locus A passes through the center Pa of the press position P. In FIGS. 5A and 5B, each cartridge holding section 43 is composed of semicircular fitting notched portions 45 in each of which the outer peripheral surfaces of the cartridges 3, 4 are fitted, support projecting portions 61 each projected to allow the cartridges 3, 4 to be placed on the corresponding fitting notched portion 45, and slipping-out preventing members 46 each of which can be engaged with and disengaged from the cartridges 3, 4 to hinder the cartridges 3, 4 fitted in the corresponding fitting notched portion 45 from slipping out from the pivoting center toward the outer periphery in a horizontal direction. Each of the support projecting portions 61 extends circularly along an inner side of the corresponding fitting notched portion 45. The support projecting portion 61 is provided in the middle of the inner side of the fitting notched portion 45 in a height direction as shown in FIGS. 7 and 8.

The support projecting portion 61 provided in each fitting notched portion 45 of each of the upper and lower replacement cartridge holding members 41, 42 engages with a downward surface of the engaging concave portions 62, 63 formed in the outer periphery of the upper and lower cartridges 3, 4, respectively. The cartridges 3, 4 are thus placed on the support projecting portion 61. The engaging concave portions 62, 63 are shaped like grooves extending all along the circumference of the cartridges 3, 4, respectively. The punch-side cartridge 3 has a stepped bottom surface having a concave outer periphery. The engaging concave portion 62 is formed in the outer periphery of the downward stepped surface of the cartridge 3. The engaging concave portion 63 of the die-side cartridge 4 is shaped like a groove having a vertical width larger than the vertical thickness of the support projecting portion 61 of the replacement cartridge holding members 41, 42. The cartridge 4 can be moved in the vertical direction a distance equal to the idle height.

As shown in FIGS. 5N, 5B and 5C, the slipping-out preventing member 46 is composed of a pair of locking levers 47 provided at the opposite side portions of the fitting notched portion 45 so as to be freely rotatively movable around a support point 47*a*, advancing and withdrawing rods 49 installed so as to freely advance and withdraw via a guide member 48, and spring members 50 that urge, via the advancing and withdrawing rods 49, the locking levers 47 toward a locked side, i.e. so that the locking levers 47 project to the cartridges 3, 4. The locking levers 47 enter the engaging concave portions 64, 65 formed in corresponding areas of the outer peripheral surfaces of the cartridges 3, 4, respectively, to hinder the cartridges 3, 4 from slipping out from the fitting notched portion 45 (FIGS. 5A and 5B) toward its opening, i.e. in the horizontal direction.

The advancing and withdrawing rods 49 in the slipping-out preventing member 46 are connected to the locking levers 47 so that an advancing and withdrawing operations of the advancing and withdrawing rods 49 rotatively move the locking levers 47 in a clamping and unclamping directions, respectively. Specifically, one end 49*a* of each advancing and withdrawing rod 49 is formed to be a rack portion that meshes with a partial pinion portion formed at a proximal end of the corresponding locking lever 47. Pushing the other end 49*a* of each advancing and withdrawing rod 49 allows the locking levers 47 to perform an unclamping operation. One of the pair of locking levers 47 is installed on a mounting plate 51 shared by one of the locking levers 47 of the adjacent cartridge holding section 43. The slipping-out preventing member 46 is urged toward the projecting side by the spring member 50 as described above. A cancellation of slipping-out preventing operation can be performed by using slipping-out preventing cancellation means 52 to operate the slipping-out preventing member 46 against the action of the spring member 50. The operation of the slipping-out preventing cancellation means 52 against the action of the spring member 50 is, for example, to push the other end 49*b* of each advancing and withdrawing rod 49 toward one end 49*a* of it. The slipping-out preventing cancellation means 52 may have an exclusive driving source (not shown in the drawings) or may be an interlocking mechanism (not shown in the drawings) interlocking with an elevating and lowering operations of the cartridge holding means 6, 7.

While stopped at a position at which the cartridges 3, 4 can be delivered to the cartridge holding means 6, 7, respectively, the corresponding cartridge holding sections 43 of the cartridge replacing devices 8, 9 deliver the cartridges 3, 4 to the cartridge holding means 6, 7 and then remain stopped while waiting to receive cartridges 3, 4 from the cartridge holding means 6, 7. Specifically, in the cartridge replacing devices 8, 9, after the cartridge holding means 6, 7 have held the cartridges 3, 4, respectively, the cartridge holding sections 43 located at the positions corresponding to the cartridge holding means 6, 7 stands by so as to receive the cartridges 3, 4 from the respective cartridge holding means 6, 7. In this embodiment, each slipping-out preventing member 46 stands by in a slipping-out preventing cancellation state in which the pair of locking levers 47 has withdrawn so as to slip out from the engaging concave portions 64, 65 (FIG. 3A) of the cartridges 3, 4, respectively. This operational timing may be obtained by electric control means for controlling the driving source for the slipping-out preventing cancellation means 52 or may be linked with an elevating and lowering operations of the cartridge holding means 6, 7 using the above interlocking mechanism.

Operations of the above arrangement will be described.

The punch-side cartridge replacing device 8 is shown in FIG. 5A. The cartridges 3, 4 holding various tools 1, 2, respectively, are held by the respective cartridge holding sections 43 provided on each of the upper and lower cartridge replacing devices 8, 9 at a plurality of positions in its circumferential direction. The cartridges 3, 4 are locked by the slipping-out preventing member 46 so as not to slip out. To use the desired cartridges 3, 4, the replacement cartridge holding member 41, 42 are pivoted to place the corresponding cartridge holding sections 43 at the press position P.

Figure 6:
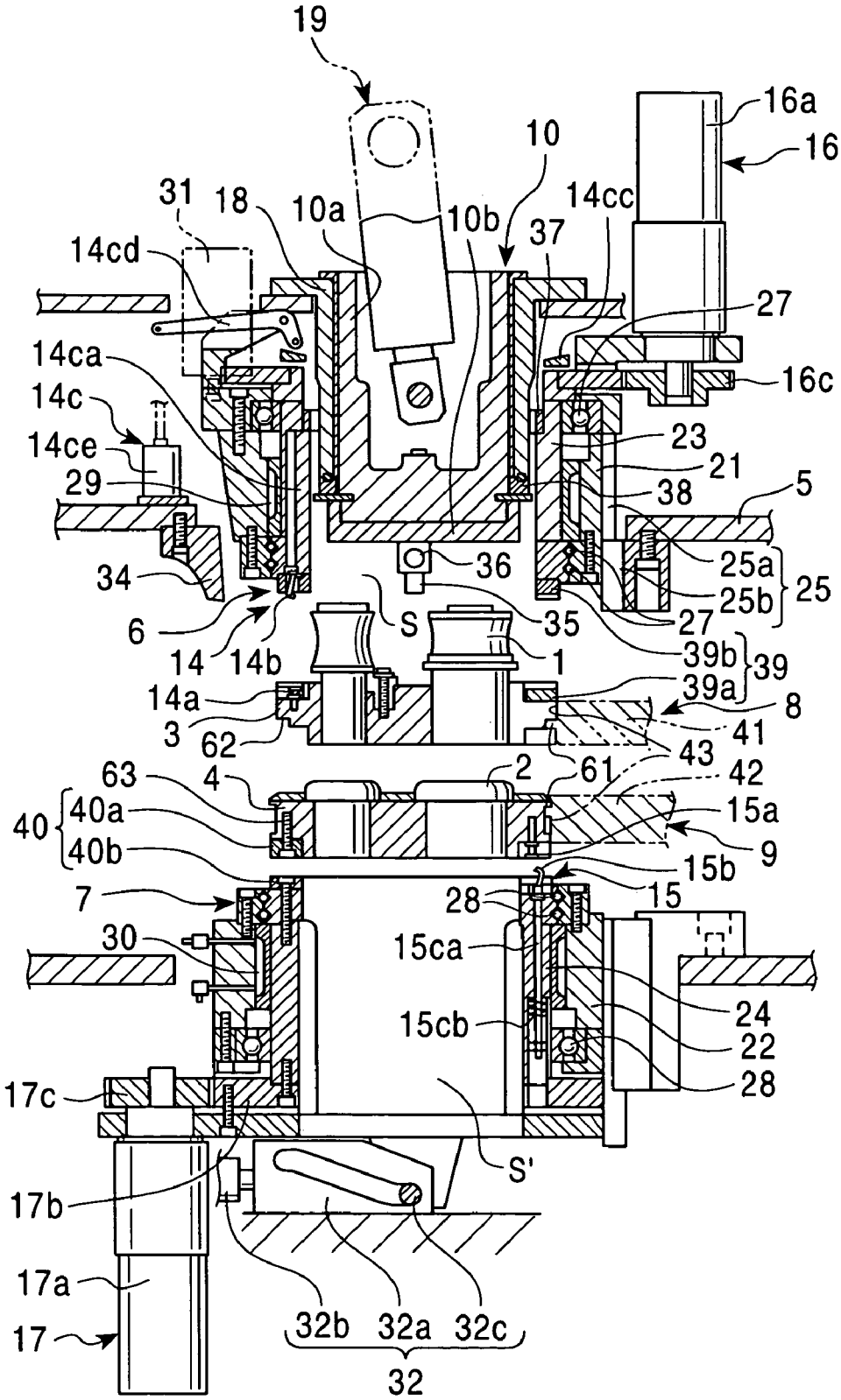
FIG. 6 is an enlarged exploded front view of essential parts of the punch press, showing that the cartridges have not been clamped.

At this time, as shown in FIG. 6, the punch cartridge holding means 6 has been withdrawn upward, whereas the die cartridge holding means 7 has been withdrawn downward. This prevents obstruction to the pivoting of the cartridges 3, 4 to the press position P. Furthermore, in the cartridge clamps 14, 15, the disengagement driving source 14*ce* has pushed the lever 14*cd* to hold the hooks 14*b*, 15*b* in an unclamped position.

When the cartridge holding sections 43 holding the desired cartridges 3, 4 reach the press position P, the punch cartridge holding means 6 is lowered, while the die cartridge holding means 7 is elevated. That is, the holding means elevating and lowering devices 31, 32 lower and elevate the elevating cylinders 21, 22 of the cartridge holding means 6, 7, respectively. Together with the elevating cylinders 21, 22, the rotating cylinder 23 is lowered, while the rotating cylinder 24 is elevated. The rotating cylinders 23, 24 contact with the cartridges 3, 4, respectively, at their tips to mesh the couplings 39, 40 with each other.

With the couplings meshed with each other, the disengagement driving source 14*ce* for the cartridge clamps 14, 15 stops pushing the lever 14*cd*. Thus, the recovery force of the spring member 15*cb* engages the hooks 14*b*, 15*b* with the engaged portions 14*a*, 15*a*, respectively. The cartridges 3, 4 are clamped against the rotating cylinders 23, 24, respectively, by the corresponding cartridge clamps 14, 15. The cartridges 3, 4 are accurately positioned on the rotating cylinders 23, 24, respectively, in their circumferential direction (FIG. 7).

Once the clamping operation is completed, the slipping-out preventing members 46 of the cartridge replacing devices 8, 9 are allowed to stand by in the slipping-out preventing cancellation state. That is, the locking levers 47 of the slipping-out preventing member 46 are opened at the press position P.

After the cartridge 3, 4 have been indexed, the desired tools 1, 2 on the cartridges 3, 4, respectively, are indexed and then used to carry out punching. The tool indexing operation will be described below.

Essentially, the origin of the striker 35 is a front position of the punch press (the position of the striker 35 in FIG. 11), and the striker 35 is normally located at this position. In FIG. 7, when the rotating cylinder 23 is rotated while the ram 10 is at its elevating end (top dead center), the cartridge 3 is rotated to index the desired tool at a position where the striker 35 can be used to carry out punching (that is, the front position). At this time, as shown in an enlarged view in the upper left of FIG. 7, the meshing tooth 37*a*, formed in the inner periphery of the rotating cylinder 23 of the interlocking mechanism 37 is disengaged from the meshing tooth 37*b*, formed in the outer periphery of the rotating ram member 10*b*. Thus, the rotating ram member 10*b* is not rotated, so that the striker 35 maintains its front position, with only the rotating cylinder 23 and cartridge 3 rotating. The lower rotating cylinder 24 is rotated synchronously with the upper rotating cylinder 24 to bring the die-side tool 2 into its front position. This synchronous rotation need not necessarily be carried out. Depending on the working to be achieved, the rotating cylinders may be synchronized to each other or only the upper or lower rotating tools 23, 24 may be rotated. The striker advance and withdrawal driving source 36 can be used to vary the position of the striker 35 to deal with the varying arrangement loci of the tools 1, i.e. the varying positions of the tools 1, 2 in the radial direction of the cartridges 3, 4.

To change the angle of the tool 1, the ram 10 is slightly lowered. Then, the meshing teeth 37*a*, 37*b* of the interlocking mechanism 37 mesh with each other to allow the rotating ram member 10*b* to rotate together with the rotating cylinder 23. In this state, the rotating cylinders 23, 24 are rotated to place, at desired angles, the tools 1, 2 on the cartridges 3, 4 which are used for punching. The rotating ram member 10*b* is rotated to pivot the striker 35 together with the tools 1, 2 to allow the tool 1 to be punched. After the tools 1, 2 have been placed at the desired angles, the rotation fixing means 29, 30 fix the rotating cylinders 23, 24 to the fixed cylinders 21, 22, respectively. This precludes the cartridges 3, 4 from being rotated. It is thus possible to set the tools 1, 2 at arbitrary angles and to cause the tools 1, 2, having non-circular, for example, rectangular or triangular cutting edges, to carry out punching at an arbitrary angle.

After the working operation has been completed using the desired tools 1, 2, the rotating cylinders 23, 24 are rotated to return the tools 1, 2 and the striker 35 to their front positions with the interlocking mechanism 37 remaining in the meshed state. The ram 10 is allowed to stand by at its elevating end. In this state, other desired tools 1, 2 on the cartridges 3, 4 are indexed relative to the striker 35. Then, these tools 1, 2 are used to carry out punching. In this manner, arbitrary tools 1, 2 on the cartridges 3, 4 are used and set at arbitrary angles to execute punching.

According to the punch press configured as described above, when a punching operation is to be performed, the cartridges 3, 4 are fixed to the cartridge holding means 6, 7 so as to be immovable in the vertical direction. Accordingly, the cartridges 3, 4 are not moved in the vertical direction, thus enabling accurate punching. Since the cartridge holding means 6, 7 have the cartridge clamps 14, 15, respectively, that removably hold the corresponding cartridges 3, 4, the cartridges 3, 4 can be easily replaced. Various types of working can be accomplished by replacing the cartridges with ones holding different types of tools 1, 2. Furthermore, the punch press has the cartridge rotating mechanisms 16, 17 to rotate the cartridges 3, 4 to index the tools 1, 2 arranged in the cartridges 3, 4. Consequently, the tools 1, 2 in the cartridges 3, 4 can be quickly indexed. All the cartridges press can be rotatively indexed using the single punch-side cartridge rotating mechanism 16 and the single die-side cartridge rotating mechanism 17 in the entire punch press.

Figure 4A:
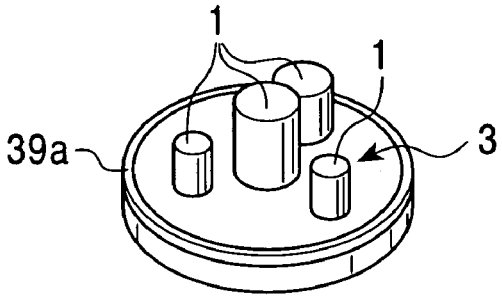
FIGS. 4A and 4B are perspective views of variations of the cartridge.
Figure 4B:
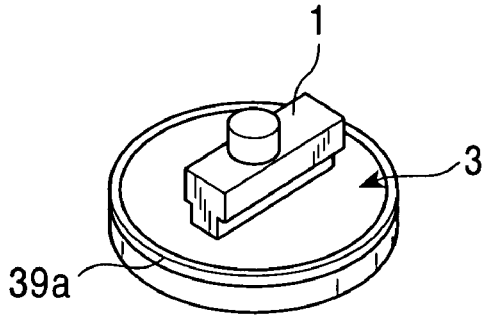

Each of the cartridge holding means 6, 7 has the space S formed in its center and through which the ram 10 elevates and lowers. Thus, for example, a large tools 1, 2 such as the one shown in FIG. 4B can be arranged in the center of the cartridge to accomplish large-scale punching.

Furthermore, the cartridge holding means 6, 7 are configured to withdraw upward and downward, respectively, as shown in FIG. 6. Consequently, when the cartridges 3, 4 are to be replaced, the tools 1, 2 on the cartridges 3, 4 or the like do not interfere with the replacement. Therefore, the cartridges 3, 4 can be easily replaced.

Moreover, the punch press is provided with the cartridge replacing devices 8, 9 to facilitate the replacement of the cartridges. The cartridge replacing devices 8, 9 move each cartridge holding section 43 along the pivoting locus passing through the press position. Accordingly, a pivoting operation can be used to place arbitrary cartridges 3, 4 at the press position. The cartridges can thus be quickly replaced.

Furthermore, since the cartridge holding means 6, 7 are provided at the press position P, the cartridge replacing devices 8, 9 deliver the cartridges 3, 4 to the cartridge holding means and then stand by with the slipping-out preventing member 46 maintained in the slipping-out preventing cancellation state. Consequently, the cartridge holding means 6, 7 can accurately hold the cartridges 3, 4, respectively. Therefore, the large number of cartridge holding sections 43, provided on the cartridge replacing devices 8, 9, need not accurately hold the cartridges. This serves to simplify the whole device. The slipping-out preventing member 46 stands by in the slipping-out preventing cancellation state, in which the pair of locking levers is open. Consequently, when the cartridge holding means 6, 7 are rotated, the locking lever 47 does not obstruct the rotation. Furthermore, when the cartridges are to be replaced again, the slipping-out preventing member 46, which has been standing by, is immediately brought into the locked state. This also reduces the time required to replace the cartridges.

The cartridge holding sections 43 on the cartridge replacing devices 8, 9 deliver the cartridges 3, 4 to the upper and lower cartridge holding means 6, 7, respectively, in the vertical direction. Consequently, the cartridges can be quickly delivered to the cartridge holding means 6, 7. Furthermore, the cartridge holding sections 43 enable the cartridges 3, 4 to be moved to and away from the press position in the horizontal direction. Thus, when the cartridges 3, 4 that are to be held by the cartridge holding sections 43 are manually replaced at a position different from the press position P, this operation is easy because the cartridges 3, 4 can be moved to and away from the press position in the horizontal direction.

In the above embodiment, each of the cartridge holding sections 43 on the cartridge replacing devices 8, 9 is composed of the fitting notched portion 45 and the slipping-out preventing member 46. However, the cartridge holding section 43 may be composed of a pair of closable clamp arms (not shown in the drawings) that hold the cartridges 3, 4 by sandwiching them between the clamp arms from the opposite sides.

In the above embodiment, the cartridge replacing devices 8, 9 are of the pivoting type having the replacement cartridge holding members 41, 42. However, the cartridge replacing devices 8, 9 have only to have a plurality of cartridge holding sections 43 so that they are movable on the predetermined locus. For example, the cartridge holding sections 43 may be arranged so as to be movable on an endless locus that may be shaped like a track. In this case, for example, the cartridge holding sections 43 are connected together like a chain. The predetermined locus may be a straight line.

The present invention provides a punch press comprising cartridges each holding at least one tool, cartridge holding means for holding the cartridges supported by a punch frame and located at a press position, and a ram located above the cartridges held by the cartridge holding means to drive the tools held by the respective cartridges to execute punching, the cartridge holding means each having a cartridge clamp removably holding the corresponding cartridges and a cartridge rotating mechanism that rotates the held cartridges around an axis parallel with an elevating and lowering direction of the ram in order to index any of the tools, the cartridge holding means fixing the cartridges during punching so that the cartridges cannot be moved in a vertical direction. Accordingly, the cartridges can be easily replaced and the replacement of the cartridges allows the use of a large number of tools. Furthermore, any of the tools in the cartridges can be quickly indexed, and the accuracy of punching can be easily improved.

If each of the cartridge holding means has a space formed in its center and through which the ram elevates and lowers, to hold an outer peripheral portion of each of the cartridges, then larger-scale punching can be accomplished.

If each of the cartridge holding means is movable between a fixed height position at which the cartridges are fixed so as to immovable in the vertical direction and a withdrawn height position at which the cartridges are moved away from the fixed height position relative to a die height, then the cartridges can be more easily replaced at the punch position.

Furthermore, the present invention provides a punch press comprising cartridges each holding at least one tool, cartridge holding means for holding the cartridges supported by a punch frame and located at a press position, a ram located above the cartridges held by the cartridge holding means to drive the tools being held by the respective cartridges to execute punching, and cartridge replacing devices each replacing the corresponding cartridges held by the corresponding cartridge holding means, and wherein each of the cartridge replacing devices has a plurality of cartridge holding sections so that the cartridge holding sections can be moved on a predetermined locus, the cartridge holding sections each holding the corresponding cartridge so as to deliver the cartridge to the corresponding cartridge holding means, the predetermined locus passing through the press position, and wherein while stopped on the predetermined locus at a position at which the cartridge can be delivered to the cartridge holding means, each of the cartridge holding sections delivers the corresponding cartridge to the corresponding cartridge holding means and then remains stopped while waiting to receive a cartridge from the cartridge holding means. Accordingly, the cartridges can be quickly and easily replaced with desired ones and the replacement of the cartridges allows the use of a large number of tools. Moreover, the accuracy of punching can be easily improved, and the punch press can be simply configured.

If each of the cartridge holding means has a space formed in its center and through which the ram elevates and lowers, to hold an outer peripheral portion of each of the cartridges, then larger-scale punching can be accomplished.

If each of the cartridge holding sections of each of the cartridge replacing devices delivers the corresponding cartridge to the corresponding cartridge holding means in the vertical direction and can move the cartridge to and away from the press position in a horizontal direction, then the cartridge can be quickly delivered to the corresponding cartridge holding means at the press position. Furthermore, when the cartridge to be held by the corresponding cartridge replacing device is manually replaced at a position different from the press position, this operation is easy.

If each of said cartridge holding means has a cartridge rotating mechanism that rotates the held cartridges around an axis parallel with an elevating and lowering direction of said ram in order to index any of the tools, then any of the tools in the cartridges can be quickly indexed. Moreover, the punch press requires only one cartridge rotating mechanism.

The invention claimed is:

1. A punch press, comprising:

cartridges each holding at least one tool therein, a cartridge holder, supported by a punch frame, for holding the cartridge located at a press position so that the cartridge cannot move in a vertical direction during punching, a ram having a striker located above the cartridge held by the cartridge holder to drive said at least one tool held by the cartridge at the press position to execute punching, and a cartridge rotating mechanism for rotating the held cartridges around an axis parallel with an elevating and lowering direction of said ram in order to index any of the cartridges, wherein said at least one tool is operated to execute punching by driving action of said striker without being integrally fixed to each other, wherein said cartridge holder has a space, formed in its center and through which said ram elevates and lowers, to hold an outer peripheral portion of each of said cartridges, and wherein said cartridge holder is movable between a fixed height position at which the cartridges are fixed so as to be immovable in the vertical direction and a withdrawn height position at which the cartridges are moved away from the fixed height position relative to a die height.

2. A punch press, comprising:

cartridges each holding at least one tool therein, a cartridge holder, supported by a punch frame, for holding the cartridge located at a press position so that the cartridge cannot move in a vertical direction during punching, a ram having a striker located above the cartridge held by the cartridge holder to drive said at least one tool held by the cartridge at the press position to execute punching, and a cartridge replacing device for replacing the cartridges to be held by said corresponding cartridge holder, wherein said cartridge replacing device has a plurality of cartridge holding sections so that the cartridge holding sections can be moved on a predetermined locus, the cartridge holding sections hold said cartridges so as to deliver the cartridge to the said cartridge holder, and said cartridge replacing device stops at a position on said predetermined locus at which the cartridge can be delivered to said cartridge holder, and wherein said cartridge holder has a space, formed in its center and through which said ram elevates and lowers, to hold an outer peripheral portion of each of said cartridges.

3. The punch press according to claim 2, wherein each of the cartridge holding sections of said cartridge replacing device delivers the corresponding cartridge to said cartridge holder in the vertical direction and can move the cartridge to and away from the press position in a horizontal direction.

4. The punch press according to claim 2, wherein, said cartridge holder has a cartridge rotating mechanism that rotates the cartridges around an axis parallel with an elevating and lowering direction of said ram in order to index said at least one tool.

5. The punch press according to claim 3, wherein, said cartridge holder has a cartridge rotating mechanism that rotates the held cartridges around an axis parallel with an elevating and lowering direction of said ram in order to index said at least one tool.

6. A punch press, comprising:

a punch press frame;

a ram having a striker to drive a punch tool to execute punching;

a die cartridge holding a die tool;

a punch cartridge holding the punch tool, the punch tool being supported on the punch cartridge so as to elevate from and return to the punch cartridge under force of a spring member, the punch cartridge being located above the die cartridge;

a punch cartridge holder, supported by the punch press frame, to hold the punch cartridge at a press position, the punch cartridge holder including a punch cartridge clamp removably holding the punch cartridge and a punch cartridge rotating mechanism that rotates the held punch cartridge around an axis parallel with an elevating and lowering direction of the ram, the punch cartridge holder holding the punch cartridge so that the punch cartridge cannot move in a vertical direction during punching;

a die cartridge holder, supported by the punch press frame, to hold the die cartridge at the press position, the die cartridge holder including a die cartridge clamp removably holding the die cartridge and a die cartridge rotating mechanism that rotates the held die cartridge around an axis parallel with an elevating and lowering direction of the ram, the die cartridge holder holding the die cartridge so that the die cartridge cannot move in a vertical direction during punching;

a punch cartridge replacing device to replace the cartridge held by the punch cartridge holder; and a die cartridge replacing device to replace the cartridge held by the die cartridge holder.

* * * * *